United States Patent [19]

Kuhn et al.

[11] Patent Number: 4,842,203

[45] Date of Patent: Jun. 27, 1989

[54] NOZZLE ASSEMBLY FOR SPRAY GUNS

[75] Inventors: Wolfgang Kuhn, Schloss Holte; Karsten Jüterbock, Herzebrock-Clarholz, both of Fed. Rep. of Germany

[73] Assignee: Kopperschmidt-Mueller GmbH & Co. KG, Bielefeld, Fed. Rep. of Germany

[21] Appl. No.: 159,115

[22] Filed: Feb. 23, 1988

[30] Foreign Application Priority Data

Feb. 24, 1987 [DE] Fed. Rep. of Germany ..... 3705815

[51] Int. Cl.[4] ..... B05B 5/00

[52] U.S. Cl. ..... 239/705; 239/706; 239/708; 239/291; 239/296; 239/299

[58] Field of Search ..... 239/691, 696, 709, 706, 239/708, 291, 296, 299

[56] References Cited

U.S. PATENT DOCUMENTS

| | | | |
|---|---|---|---|
| 3,583,632 | 6/1971 | Shaffer et al. | 239/15 |
| 3,659,787 | 5/1972 | Ito | 239/15 |
| 3,764,068 | 10/1973 | Lacchia | 239/3 |
| 3,907,202 | 9/1975 | Binoche | 239/705 |
| 4,055,300 | 10/1977 | Binoche | 239/296 X |
| 4,236,674 | 12/1980 | Dixon | 239/296 |
| 4,245,784 | 1/1981 | Garcin | 239/708 X |
| 4,258,885 | 3/1981 | Legeza | 239/707 |
| 4,497,447 | 2/1985 | Mommsen | 239/691 |
| 4,713,257 | 12/1987 | Luttermöller | 427/27 |

FOREIGN PATENT DOCUMENTS

| | | | |
|---|---|---|---|
| 2446022 | 4/1976 | Fed. Rep. of Germany . | |
| 2615360 | 10/1976 | Fed. Rep. of Germany . | |
| 7717280 | 2/1978 | Fed. Rep. of Germany . | |
| 2713328 | 10/1978 | Fed. Rep. of Germany | 239/691 |

*Primary Examiner*—Andres Kashnikow
*Assistant Examiner*—Patrick N. Burkhart
*Attorney, Agent, or Firm*—Peter K. Kontler

[57] ABSTRACT

The nozzle assembly of an electrostatic spray gun has an adapter which is made of an electrically insulating material and has a front surface facing in the direction of propagation of material issuing from the orifice of the nozzle. The adapter has a frustoconical extension which surrounds the orifice and whose external surface defines with the front surface of the adapter an annular space for the tips of electrodes which ionize air flowing toward the spray of material that issues from the orifice. The locations of the tips of electrodes (preferably very close to the front surface of the adapter) and the inclination of the external surface of the frustoconical extension determine the location of contact of ionized air with the spray. The tips of the electrodes are shielded from mechanical damage by being located in the annular space.

15 Claims, 2 Drawing Sheets

NOZZLE ASSEMBLY FOR SPRAY GUNS

BACKGROUND OF THE INVENTION

The invention relates to hydrostatic spray guns in general, and more particularly to improvements in nozzle assemblies for hydrostatic spray guns. Still more particularly, the invention relates to improvements in nozzle assemblies of the type wherein an adapter which is connectable to a barrel or to another support is made of an electrically insulating material and carries one or more high-voltage electrodes serving to ionize air which is used to atomize the material to be sprayed as such material issues from the orifice of the nozzle in the nozzle assembly.

German Auslegeschrift No. 24 46 022 of Vöhringer discloses a nozzle assembly wherein the adapter has a flat front surface with a centrally located bore constituting the material discharging orifice. The orifice is surrounded by an annulus of holes which discharge streams of air serving to atomize the material which issues from the orifice. Two ported horn-like projections of the adapter extend forwardly beyond the front surface at opposite sides of the orifice and are located outwardly of the annulus of holes; their ports discharge streams of auxiliary air which is intended to promote the atomizing action of air issuing from the aforementioned holes or to shape the spray of material which issues from the orifice. High-voltage electrodes extend from the projections in close or immediate proximity to the respective ports in order to ionize the air streams. The tips of the electrodes extend from the projections through distances in the range of several millimeters, and they are located close to the periphery of the nozzle assembly. The function of such electrodes is to ionize air which issues from the ports of the respective projections as well as to ionize air which is drawn toward the spray by streams of air issuing from the ports and/or from the holes surrounding the orifice. When the ionized air contacts the spray, it transfers its charge to the droplets of the material to be sprayed so that the droplets can readily follow the paths which are determined by the lines of the electrostatic field. The locus of impingement of ionized air upon the material of the spray is determined by the primary function of air, namely by its atomizing or spray forming action.

In accordance with another earlier proposal which is disclosed in U.S. Pat. No. 3,764,068 to Lacchia, the orifice which serves to discharge the material to be sprayed is surrounded by six equidistant hollow needle-like electrodes which project well beyond the front side of the adapter. The orifice for the material to be sprayed is a ring-shaped opening which is surrounded by a second ring-shaped ofifice for atomizing air. The electrodes are placed close to the periphery of the adapter and their passages are designed to deliver streams of liquid (with or without air). Such liquid is ionized and is caused to contact the material issuing from the inner ring-shaped orifice. A drawback of the patented nozzle assembly, as well as of that which is disclosed by Vöhringer, is that the electrodes are not adequately shielded because they project well beyond the adjacent portions of the adapter. Moreover, the electrodes are close to the periphery of the nozzle assembly so that the likelihood of sparking is very pronounced if the nozzle assembly is moved close to a grounded object.

Another presently known nozzle assembly is disclosed in German Utility Model No. 77 17 280 of S.K.M. This nozzle assembly employs two horns which are disposed at opposite sides of the orifice for the material to be sprayed and project well beyond the front surface of the adapter. The horns carry electrodes which protrude toward the path for the spray, and additional electrodes are installed in the adapter to project from its front surface. The electrodes which are installed in the horns are likely to come into contact with the object or objects to be coated.

German Offenlegungsschrift No. 26 15 360 of Buschor et al. discloses a nozzle assembly wherein the tips of the electrodes project well beyond the front side of the adapter. The latter can be provided with a ring-shaped shield which surrounds the electrodes, or the electrodes are disposed in an annular recess which is surrounded by a nut serving to couple the adapter to the barrel of a spray gun. Alternatively, the recess can be formed directly in the front side of the adapter. A drawback of the proposal of Buschor et al. is that the electrodes are exposed and are likely to be damaged or that the electrodes are overly concealed so that they cannot ensure adequate ionization of secondary air.

Further conventional nozzle assemblies for use in spray guns are disclosed in U.S. Pat. No. 3,583,632 to Shaffer et al., in U.S. Pat. No. 4,055,300 to Binoche, in U.S. Pat. No. 4,258,885 to Legeza, and in commonly owned U.S. Pat. No. 4,713,257 to Luttermöller.

OBJECTS AND SUMMARY OF THE INVENTION

An object of the invention is to provide a nozzle assembly for electrostatic spray guns which ensures highly satisfactory charging of the material to be sprayed and wherein the electrode or electrodes are adequately shielded from physical contact with solid objects and from resulting damage.

Another object of the invention is to provide a nozzle assembly which can be used in many types of conventional spray guns.

A further object of the invention is to provide a spray gun which embodies the above outlined nozzle assembly.

An additional object of the invention is to provide a novel and improved method of charging the material to be sprayed after it issues from the orifice of the nozzle in the nozzle assembly of a spray gun.

Still another object of the invention is to provide the adapter of the nozzle assembly with novel and improved means for influencing the flow of ionized air toward the spray in front of the orifice.

Another object of the invention is to provide a novel and improved arrangement for shielding the tips of electrodes in the above outlined nozzle assembly.

A further object of the invention is to provide a nozzle assembly wherein the streams of ionized air can influence the charging of the spray as well as the shaping of the spray and atomization of the particles or droplets which form the spray.

An additional object of the invention is to provide a novel and improved adapter for use in the above outlined nozzle assembly.

A further object of the invention is to provide the nozzle assembly with novel and improved means for preventing sparking when the adapter is moved close to a grounded object.

An additional object of the invention is to provide a versatile nozzle assembly which can be used for the spraying of a wide variety of materials including materials of average or even pronounced conductivity.

The invention is embodied in a spray gun, and more particularly in a nozzle assembly which can be used in an electrostatic spray gun and comprises an adapter of electrically insulating material. The adapter can be attached to the barrel of a spray gun and has a centrally located orifice for the material to be sprayed and a forwardly tapering extension surrounding the orifice. The adapter has a front surface which surrounds the extension, and the latter has a base at the front surface and an external surface defining with the front surface an annular space which surrounds the extension. The nozzle assembly further comprises means for charging the material which issues from the orifice, and such charging means includes at least one electrode which is carried by the adapter and is disposed in the annular space in the region of the base. The charging means can comprise a plurality (e.g., an annulus of three, four or more) preferably equidistant electrodes which surround the orifice. The tip of each elecrode is preferably closely or immediately adjacent the front surface of the adapter. In order to reduce the likelihood of physical contact between the nozzle proper and the object to which the sprayed material is to be applied, the extension can be provided with a substantially centrally located recess and the orifice is then located in the recess so that at least a portion of (or the entire) extension projects forwardly beyond the orifice (the term "forwardly" is intended to denote that a part extends in the direction of the flow of material from the orifice, and the term "front" is intended to denote that side of surface which faces in the direction of propagation of material which issues from the orifice).

The orifice can discharge the material to be sprayed in the form of at least one sheet-like body consisting of coherent liquid droplets, and such sheet-like body begins to disintegrate into discrete droplets (i.e., the atomizing of the material begins) at a predetermined distance from the orifice (namely in front of the orifice). An imaginary straight line which touches the tip of the at least one electrode and the external surface of the extension and is located in a plane including the axis of the extension and the orifice preferably intersects the sheet-like body at or close to the predetermined distance from the orifice.

The extension can be provided with an annular air-discharging second orifice which surrounds the orifice for the material to be sprayed. Such second orifice is preferably located forwardly of the base of the extension. The external surface of the extension can constitute or resemble a substantially frustoconical surface having a maximum diameter at the base of the extension, and the second orifice is preferably at least substantially concentric with the orifice for the material to be sprayed and has a maximum diameter which is less than the maximum diameter of the frustoconical external surface.

The adapter can further comprise a plurality of hollow gas supplying members or nozzles which project forwardly beyond (e.g., from) the front surface and have air discharging ports serving to direct streams of air against the material which issues from the orifice for the material to be sprayed. The adapter can comprise two gas supplying members which are disposed at opposite sides of the orifice for the material to be sprayed. The at least one electrode is preferably offset relative to the gas supplying members of the adapter in the circumferential direction of the extension. A straight line which touches the tip of the at least one electrode and the external surface of the extension and is located in the plane including the common axis of the extension and the orifice for the material to be sprayed intersects the common axis at a locus which is disposed at a predetermined distance from and in front of the orifice for the material to be sprayed. The ports of the gas supplying members have axes which preferably intersect the common axis between the aforementioned locus and the orifice for the material to be sprayed.

The nozzle assembly can further comprise means (e.g., one or more channels) for supplying to the orifice a material of average or pronounced electric conductivity.

The orifice can resemble or constitute a slit and can be located forwardly of the front surface of the adapter. The front surface can be substantially flat, in contrast to the external surface which preferably resembles or constitutes the frustum of a cone. The external surface can include two or more mutually inclined annular portions.

The novel features which are considered as characteristic of the invention are set forth in particular in the appended claims. The improved nozzle assembly itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
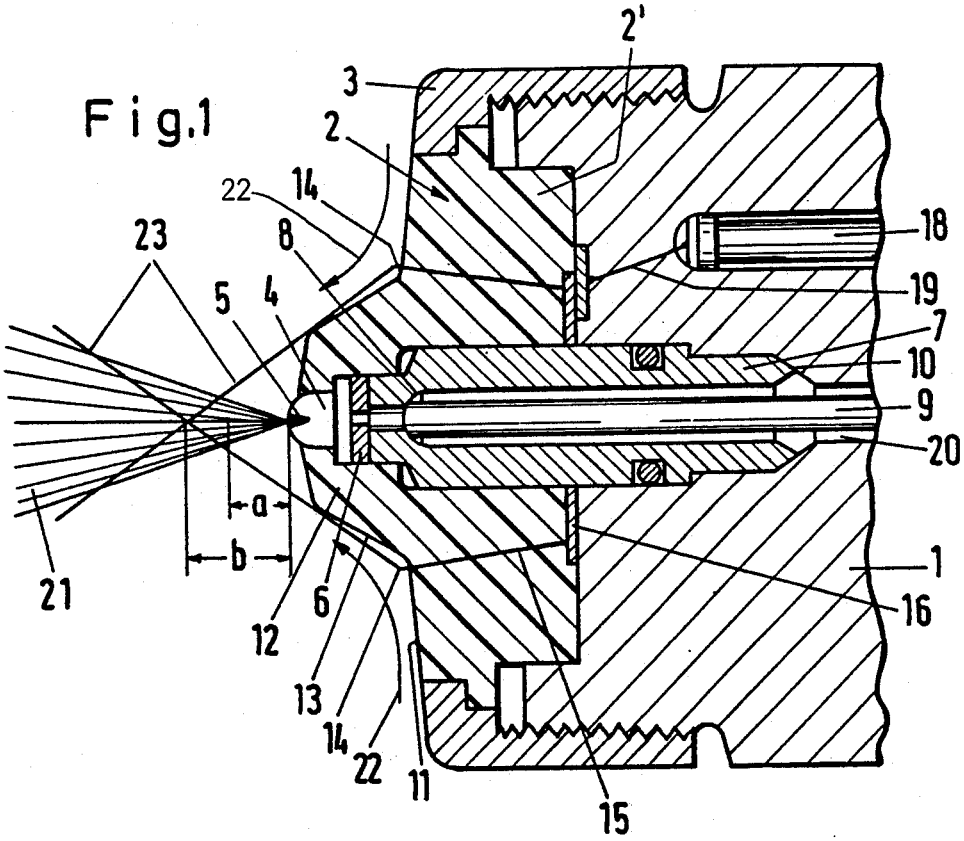
FIG. 1 is fragmentary central sectional view of a spray gun including a nozzle assembly which embodies one form of the invention.

FIG. 1 shows a portion of an electrostatic spray gun which includes a barrel 1 or an analogous support for a nozzle assembly 2 including an adapter 2' which is made of an electrically insulating material and is separably affixed to the support 1 by a nut 3. The nozzle 4 of the assembly 2 is located centrally of the adapter 2' and has a slit-shaped orifice 5 for the material to be sprayed. The rear side of the nozzle 4 abuts a ring-shaped washer-like sealing element 6 which is located in front of a valve housing 7. The latter extends in part into the insert 2' behind the nozzle 4 and in part into the support 1 and defines an annular seat 8 for the front end portion of a reciprocable rod-like valving element 9. The housing 7 receives material to be sprayed by way of a channel 20 in the support 1. This support has a forwardly and outwardly flaring internal shoulder 10 serving as an abutment for a complementary shoulder of the valve housing 7 so that the latter is held in a predetermined position when the nut 3 is applied to attach the adapter 2' to the support 1. The sealing element 6 is then maintained in a compressed condition and its central opening defines a portion of a path for the flow of material to be sprayed from the channel 20, through the housing 7, within the seat 8 (in retracted position of the valving element 9), through the sealing element 6 and into the orifice 5 of the nozzle 4.

The adapter 2' has a front surface 11 which is located in or close to a plane extending at right angles to the common axis of the nozzle 4, orifice 5 and the valve (including the parts 7, 9). The adapter 2' further comprises a centrally located extension 12 which projects forwardly beyond the front surface 11 and has a frustoconical external surface 13 tapering forwardly in the direction of flow of the material which is being sprayed by the nozzle 4 and issues from the orifice 5. The front surface 11 extends all the way to the foremost portion of the nut 3 and serves to define with the frustoconical external surface 13 of the extension 12 a relatively shallow annular space which surrounds the extension and accommodates the tips of several preferably equidistant high-voltage electrodes 14 in the region close to or actually at the base (maximum-diameter portion) of the extension 12. The nozzle assembly 2 of FIG. 1 is assumed to comprise a charging unit including four equidistant high voltage electrodes 14 which form an annulus surrounding the orifice 5 and the extension 12 and having tips in or very close to or immediately adjacent the front surface 11 of the adapter 2' in the region of the base of the extension 12. The four electrodes 14 are equidistant from each other in the circumferential direction of the extension 12 The feature that the tips of the electrodes 14 are disposed in the aforementioned annular space which is defined by the front surface 11 and the external surface 13 ensures that the electrodes are reliably shielded from contact with the part or parts to be coated when the spray gun is in use.

Each electrode 14 is connected with a discrete conductor 15 which passes rearwardly through the adapter 2' and is connected to a ring-shaped distributor 16. The latter is installed in the rear surface of the adapter 2' and is in contact with a conductor 19 which is connected with a suitable energy source (not specifically shown) and is provided with a resistor 18.

The channel 20 receives material to be sprayed from a suitable source (not shown in FIG. 1) wherein the material is maintained at an elevated pressure, and the material issues from the orifice 5 (when the valve 7, 9 is open) to form a spray 21 which can be said to include a substantially sheet-like body of coherent liquid droplets at least within a distance a from the orifice 5. The body begins to disintegrate into discrete droplets (i.e., to be atomized) not later than at a predetermined distance b from the orifice 5. The rapidly flowing material which forms the spray 21 entrains air which flows along the front surface 11 and thereupon along the external surface 13 of the extension 12 (note the arrows 22). Such air is ionized by the electrodes 14 before it contacts the spray 21 and follows the electrostatic field as well as the path which is determined by the flow of material that issues from the orifice 5. The electrostatic field is influenced by the extension 12. Thus, an imaginary straight line 23 which touches the tip of an electrode 14, which also touches the external surface 13 of the extension 12, and which is located in a plane including the axis of the nozzle 4 and its orifice 5 intersects the common axis of the nozzle 4 and extension 12 at a locus which is spaced apart from the orifice 5 a distance equal to or approximating the aforementioned distance b where the atomizing of the sheet of coherent droplets forming the rightmost portion of the spray 21 begins. Since the major part of ionized air which flows in the directions indicated by arrows 22 reaches the spray 21 only at or close to the locus of intersection of lines 23 with the axis of the extension 12, the nozzle assembly 2 ensures a highly satisfactory charging of the particles which form the spray 21. Such charging is enhanced due to the fact that air flows toward the spray 21 in several directions, namely all the way around the external surface 13 of the extension 12 in a direction from the front surface 11 of the adapter 2' toward the spray 21.

The channel 20 can deliver to the nozzle 7, 9 a material which exhibits an average or pronounced conductivity, for example, water soluble lacquers. This is due to the fact that the distances from the tips of the electrodes 14 to the spray 21 are sufficiently great to avoid sparking.

An advantage of the improved nozzle assembly 2 is that the annular space which is bounded by the surfaces 11 and 13 can receive the tips of the electrodes 14 so that such tips are reliably shielded against mechanical damage. Moreover, the surfaces 11 and 13 guide streams of air (arrows 22) toward the tips of the electrodes 14 to ensure satisfactory ionization, and thereupon to the spray 21 to ensure satisfactory charging of the material forming the spray. Air flowing in the directions which are indicated by arrows 22 is drawn by the material issuing from the orifice 5. The inclination of the external surface 13 and the locations of the tips of electrodes 14 relative to the base of the extension 12 determine the locus (at or close to the distance b from the orifice 5) where the streams of ionized air reach the spray 21. Thus, by the simple expedient of selecting the positions of the tips of electrodes 14 relative to the base of the extension 12 and/or by appropriate selection of the inclination of the external surface 13 relative to the axis of the nozzle 4, the maker of the nozzle assembly 2 can select the extent to which the material issuing from the orifice 5 is charged as a result of contact with streams of ionized air.

The feature that the adapter 2' consists of electrically insulating material also contributes to a more satisfactory charging of the material of the spray 21. Thus, in the first phase, the adapter 2' acts not unlike a dielectric insulator between the individual electrodes 14 and the material which issues from the orifice 5 and whose electric potential is low.

An advantage of placing the tips of electrodes 14 close to the base of the extension 12 (i.e., at a relatively great distance from the nut 3 and from the periphery of the nozzle assembly 2') is that such positioning of the electrodes reduces the likelihood of sparking when the nozzle assembly 2 is moved close to one or more grounded parts. This is in contrast to many presently known nozzle assemblies where the tips of the electrodes are placed close to the periphery of the nozzle assembly.

While the nozzle assembly 2 could operate with a single electrode 14, it is presently preferred to employ an annulus of several electrodes which are equidistant from each other in the circumferential direction of the extension 12. This contributes to uniformity of the transfer of charge to the material which issues from the nozzle 5. As a rule, the ranges of neighboring electrodes 14 overlap each other to ensure a highly satisfactory uniform and pronounced charging of the material.

The likelihood of damage to the electrodes 14 is practically nil if the tips of the electrodes are immediately or closely adjacent the front surface 11 of the adapter 2' and if such tips are adjacent or provided in the base of the extension 12. It has been found that the tips of the electrodes 14 are adequately protected if they do not extend from the surface 11 by more than 6 mm. It is presently preferred to install the electrodes 14 in the adapter 2' in such a way that their tips do not project more than 1 mm (and preferably less) beyond the surface 11 and/or 13. In fact, the charging of material which issues from the orifice 5 is satisfactory even if the tips of the electrodes 14 are recessed into the adapter 2', especially if the charging means of the nozzle assembly 2 comprises a relatively large number of electrodes.

The angle of the external surface 13 and the locations of tips of the electrodes 14 determine the exact distance where the lines 23 intersect the axis of the nozzle 5. As mentioned above, the locus of intersection is preferably placed at such a distance (b) from the orifice 5 that the material which issues from the orifice begins to disintegrate into droplets in the region where it is contacted by streams of ionized air. This ensures that the material is contacted by ionized air in the region where such material is most likely to accept a substantial charge.

The channel 20 can deliver materials which exhibit an average or even a high or very high electric conductivity, such as water-soluble lacquers and many types of dissolving, disintegrating and/or separating agents. Spraying of such materials is possible because the extension 12 increases the distances from the electrodes 14 to the material which forms the spray 21, i.e., the material which issues from the orifice 5 is highly unlikely to come in direct contact with the tips of the electrodes.

The improved nozzle assembly can be used in portable or stationary spray guns wherein the material to be sprayed is atomized by air as well as in spray guns wherein the material is subjected to hydrostatic atomizing (this technique is known as airless atomizing). If streams of auxiliary air are used (e.g., in a manner to be described in connection with FIGS. 4–5) in a spray gun wherein the material to be sprayed is atomized by air, streams of auxiliary air serve to shape the spray. On the other hand, if auxiliary air is used in a spray gun wherein the material to be sprayed is atomized by hydrostatic means, streams of auxiliary air can serve to assist the main stream or streams of atomizing air in carrying out the atomizing operation (this technique is known as airless plus).

Figure 2:
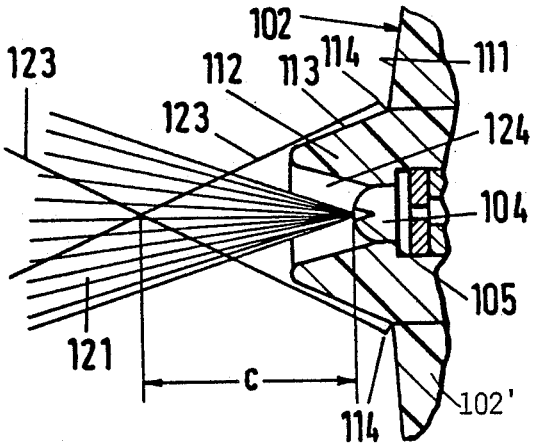
FIG. 2 is a fragmentary central sectional view of a modified nozzle assembly.
Figure 3:
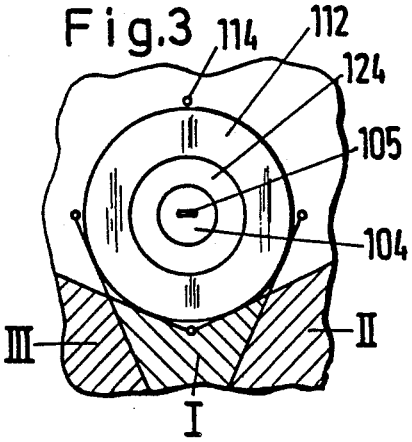
FIG. 3 is a fragmentary front elevational view of the modified nozzle assembly.

FIGS. 2 and 3 show a modified nozzle assembly 102 wherein all such parts which are identical with or clearly analogous to the corresponding parts of the assembly 2 of FIG. 1 are denoted by similar reference characters plus 100. One of the differences between the nozzle assemblies 2 and 102 is that the conicity of the external surface 113 of the extension 112 is more pronounced than that of the external surface 13 and that the central portion of the extension 112 has a recess 124 for the nozzle 104 and its slit-shaped orifice 105 so that the latter is located behind the foremost portion of the extension 112. The recess 124 is bounded by the frustoconical surface which tapers in a direction counter to that of the flow of material to be sprayed from the orifice 105. As can be seen in FIG. 2, the orifice 105 is located only slightly in front of the front surface 111 of the adapter 102' in contrast to the embodiment of FIG. 1 wherein the orifice 5 is located well ahead of the surface 11 and also in front of the foremost portion of the extension 12. The taper of the external surface 113 is constant in contrast to that of the external surface 13 which includes two mutually inclined annular portions; one of these annular portions extends forwardly from the base of the extension 12 and the other annular surface immediately surrounds the convex surface of the nozzle 4.

The purpose of placing the nozzle 104 and its orifice 105 into the recess 124 of the extension 112 is to ensure that the locus where the lines 123 intersect the common axis of the nozzle 104 and extension 112 is disposed at a greater distance (c) from the orifice 104.

FIG. 3 shows that the charging means of the nozzle assembly 102 comprises four equidistant electrodes 114 whose tips are located in the annular space bounded by the front surface 111 and by the frustoconical external surface 113 and are equidistant from one another in the circumferential direction of the extension 112. The electrodes 114 are effective in the radial direction as well as laterally within the electrostatic field. Therefore, each such electrode can ionize secondary air which flows toward the extension 112 in the respective region I while the air flowing in regions II and III is ionized by a pair of neighboring electrodes 114. The area around the extension 112 can be divided into four regions I, plus two regions II plus two regions III.

The nozzle assembly 102 exhibits the advantage that the designer is afforded an additional opportunity to influence the locus of impingement of ionized air upon the spray 121, namely by selecting the distance of the orifice 105 in the recess 124 from the foremost portion of the extension 112 and hence the distance c where the lines 123 intersect the axis of the nozzle 105. As a rule, the location of the orifice 105 with reference to the foremost portion of the extension 112 will be selected with a view to increase the distance c.

Figure 5:
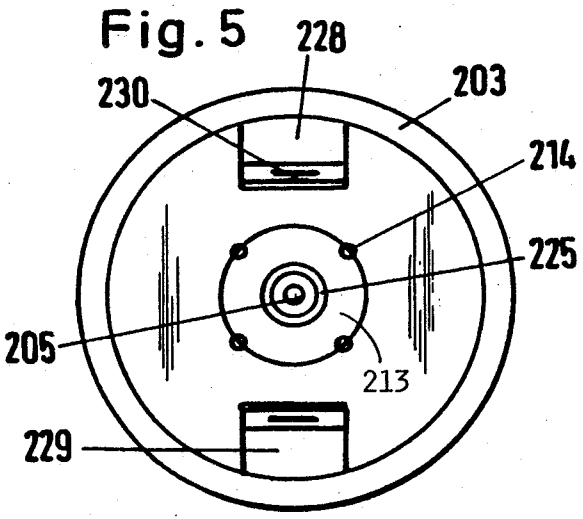
FIG. 5 is a front elevational view of a nozzle assembly which constitutes a slight modification of the nozzle assembly of FIG. 4.
Figure 4:
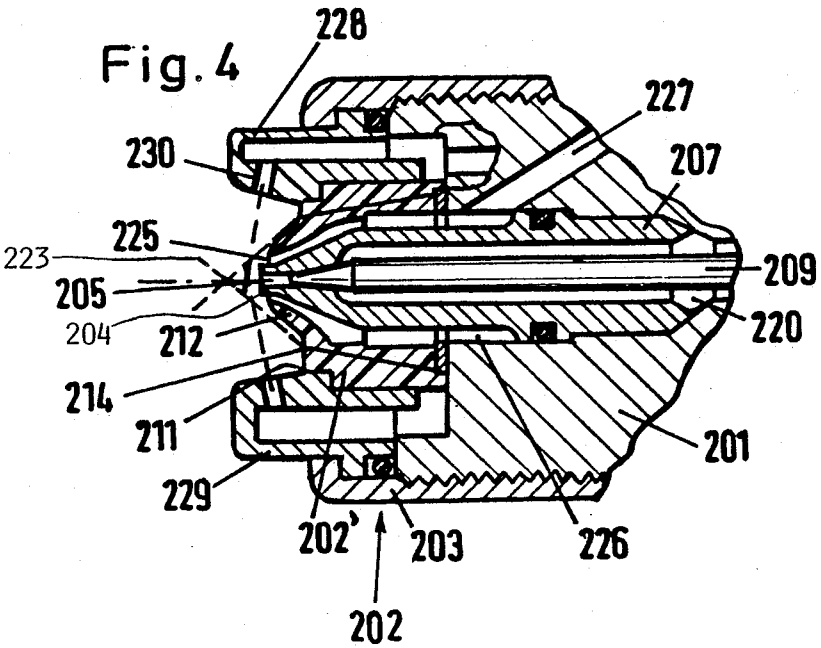
FIG. 4 is a fragmentary central sectional view of a spray gun including a third nozzle assembly.

FIGS. 4 and 5 show a further nozzle assembly 202 wherein all such parts which are identical with or analogous to corresponding parts of the nozzle assembly 2 of FIG. 1 are denoted by similar reference characters plus 200. The valving element 209 of the nozzle assembly 202 resembles a rod which is reciprocable relative to the valve housing 207 to permit or prevent the flow of material to be sprayed into the orifice 205 of the nozzle 204. The arrangement is such that the channel 220 supplies the material to be sprayed at a pressure which barely suffices to ensure the flow of such material into the nozzle 205 when the valve 207, 209 is open. The orifice 205 is surrounded by an annular second orifice 225 which discharges a stream of highly compressed air or another gaseous fluid serving to atomize the material issuing from the orifice 205. The orifice 225 is concentric with the orifice 205 and is located forwardly of the base of the frustoconical extension 212 of the adapter 202'. The orifice 225 communicates with an annular chamber 226 which is provided in part in the adapter 202' and in part in the support 201 and receives compressed gaseous atomizing fluid by way of a passage 227 in the support 201.

The extension 212 projects forwardly from the front surface 211 of the extension 202' and its foremost portion constitutes the nozzle 204 which defines the orifice 205.

The nozzle assembly 202 further comprises two hollow gas supplying members (also called air nozzles or horns) 228, 229 which project forwardly beyond the front surface 211 of the adapter 202' and are provided with ports 230 for secondary air. The axes of the ports 230 are oriented in such a way that they intersect the common axis of the orifices 205, 225 and extension 212 between the orifice 205 and the locus where the lines 223 touching the tips of the electrodes 214 and the external surface 213 of the extension 212 intersect such axis. The gas supplying members 228, 229 are disposed at opposite sides of the orifice 205, preferably diametrically opposite each other (see FIG. 5).

The tips of the electrodes 214 are located at the base of the extension 212 and close to or in the front surface 211 of the adapter 202'. As can be seen in FIG. 5, the arrangement is preferably such that the tips of the electrodes 214 are staggered with reference to the ports 230 of the gas supplying members 228, 229 in the circumferential direction of the extension 212. FIG. 4 shows that the two illustrated electrodes 214 have tips which are inwardly adjacent the respective ports 230 so that they necessarily receive streams of atomizing air. In many (or perhaps most) instances, it is preferred to stagger the tips of the electrodes 214 relative to the ports 230 in a manner as shown in FIG. 5 (this is the difference between the embodiments of FIGS. 4 and 5) because such distribution of electrodes and ports contributes to more uniform ionization of air which is used to atomize the material issuing from the orifice 205. The aforediscussed orientation of axes of the ports 230 (so that they intersect the axis of the extension 212 rearwardly of the locus of intersection of such axis with the lines 223) also contributes to more satisfactory ionization of air.

The gas supplying members 228, 229 (or analogous means for supplying streams of air or another suitable gas) can also be used in the hydrostatic nozzle assembly 2 of FIG. 1 and/or in the hydrostatic nozzle assembly 102 of FIGS. 2–3. Streams of gaseous fluid which issue from the ports of such gas supplying members assist in the atomizing operation so that it is possible to operate with lower hydrostatic pressures. In addition, streams of gaseous fluid issuing from the ports of the gas supplying members are ionized and thus contribute to charging of the material to be sprayed.

The placing of the annular orifice 225 for atomizing air forwardly of the base of the extension 212 is desirable and advantageous because air which issues from the orifice 225 draws secondary air along the front surface 211 and from the base toward the apex of the extension 212 so that such secondary air is charged by the tips of the electrodes 214. The just mentioned secondary air flows under the action of air issuing from the orifice 225, i.e., in addition to secondary air which issues from the ports 230 of the gas supplying members 228, 229. The streams of air which issue from the ports 230 not only contribute to atomizing of the material of the spray which issues from the orifice 205 but also to the shaping of such spray. In other words, even in the absence of any ionization by the electrodes 214, streams of air which are supplied by the gas supplying members 228, 229 exert a beneficial influence upon the spray by assisting in atomization and/or by imparting to the spray a desired shape.

Staggering of electrodes 214 relative to the ports 230 of the members 228, 229 in a manner as shown in FIG. 5 is desirable and advantageous because this ensures that a larger quantity of air is ionized before it contacts the spray. Thus, the electrodes then ionize at least some air which is supplied by the ports 230 as well as those streams of air which flow along the front surface 211 and along the tips of the electrodes 214 toward the foremost portion of the extension 212 under the action of compressed air issuing from the annular orifice 225 in front of the base of the extension 212.

The feature that the streams of air issuing from the ports 230 intersect the axis of the orifice 205 between such orifice and the locus of intersection of the axis with the lines 223 also enhances the atomizing and charging operation by ensuring that the concentrated electrostatic field cannot act upon the spray rearwardly of the region where the originally sheet-like body of material to be sprayed begins to disintegrate into droplets or into individual particles.

The improved nozzle assembly is susceptible of additional modifications. For example, a portion of or the entire front surface of the adapter and/or a portion of or the entire external surface of its extension can have concave or convex outline. Moreover, the tips of the electrodes need not be located in immediate proximity of the base of the extension but can be placed into the extension in front of the base or into the front surface adjacent the base of the extension. Still further, and as mentioned above, the spray gun employing the improved nozzle assembly can be operated in an atomsphere of gaseous fluid which is other than (e.g., equivalent to) air.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a spray gun, a nozzle assembly comprising an adapter of electrically insulating material, said adapter having a centrally located orifice for the material to be sprayed and a forwardly tapering extension surrounding said orifice, said adapter further having a peripheral surface, a front surface surrounding said extension and extending to said peripheral surface, said extension having a base at said front surface and an external surface defining with said front surface an annular space surrounding said extension and permitting substantially unobstructed flow of air radially inwardly along said front surface toward said external surface and into contact with sprayed material in response to spraying of material by way of said orifice; and means for charging the material which issues from said orifice, including at least one high-voltage electrode carried by said adapter and having a tip which is disposed in said space in the region of said base to ionize the air flowing toward contact with sprayed material.

2. The nozzle assembly of claim 1, wherein said charging means comprises a plurality of substantially equidistant electrodes surrounding said orifice.

3. The nozzle assembly of claim 1, wherein said tip is closely or immediately adjacent said front surface.

4. The nozzle assembly of claim 1, wherein said extension has a substantially centrally located recess and said orifice is located in said recess so that at least a portion of said extension projects forwardly beyond said orifice.

5. The nozzle assembly of claim 1, wherein said orifice is arranged to discharge material in the form of at least one substantially sheet-like body consisting of coherent liquid droplets and beginning to disintegrate into discrete droplets at a predetermined distance from said orifice, an imaginary straight line which touches said tip and said external surface and is disposed in a plane including the axis of said extension intersecting said body at or close to said predetermined distance from said orifice.

6. The nozzle assembly of claim 1, wherein said extension has an annular air-discharging second orifice surrounding said orifice for the material to be sprayed, said second orifice being located forwardly of the base of said extension.

7. The nozzle assembly of claim 6, wherein said external surface is a substantially frustoconical surface having a maximum diameter at the base of said extension, said second orifice being at least substantially concentric with said orifice for the material to be sprayed and having a maximum diameter less than the maximum diameter of said external surface.

8. The nozzle assembly of claim 1, wherein said adapter further comprises a plurality of hollow gas supplying members projecting forwardly beyond said front surface and having gas discharging ports arranged to direct streams of gas against the material which issues from the orifice for the material to be sprayed.

9. The nozzle assembly of claim 8, wherein said gas supplying members include first and second members which are disposed at opposite sides of the orifice for the material to be sprayed.

10. The nozzle assembly of claim 8, wherein said at least one electrode is offset relative to said gas supplying members in the circumferential direction of said extension.

11. The nozzle assembly of claim 8, wherein said extension has an axis which is common to said orifices and a straight line which touches said tip and said external surface and is located in a plane including said axis intersecting the axis at a locus which is spaced apart from and is located in front of said orifices, said ports having axes which intersect the axis of said extension intermediate said locus and said orifices.

12. The nozzle assembly of claim 1, further comprising means for supplying to said orifice a material of average or pronounced electric conductivity.

13. The nozzle assembly of claim 1, wherein said orifice is substantially slit shaped and is located forwardly of said front surface.

14. The nozzle assembly of claim 1, wherein said front surface is substantially flat and said external surface is substantially frustoconical.

15. The nozzle assembly of claim 1, wherein said external surface includes a plurality of mutually inclined annular portions.

* * * * *